US005992188A

United States Patent [19]

Saunders

[11] Patent Number: 5,992,188

[45] Date of Patent: Nov. 30, 1999

[54] DOOR LOCK SYSTEM

[76] Inventor: John A Saunders, 306 Charles St., Rockville, Md. 20850

[21] Appl. No.: 09/098,573

[22] Filed: Jun. 17, 1998

[51] Int. Cl.[6] ..... E05B 63/14

[52] U.S. Cl. ..... 70/120; 292/39; 292/DIG. 51; 292/DIG. 21; 292/142; 70/118

[58] Field of Search ..... 70/120, 118, 113, 70/DIG. 11; 292/39, 142, DIG. 51, DIG. 57, DIG. 21, DIG. 36, 150

[56] References Cited

U.S. PATENT DOCUMENTS

| | | | |
|---|---|---|---|
| 636,325 | 11/1899 | Eyster | 70/114 |
| 1,179,731 | 4/1916 | McDonald | 292/39 |
| 1,319,603 | 10/1919 | Monfet | 292/DIG. 21 |
| 1,366,015 | 1/1921 | Morris | 70/114 |
| 1,567,811 | 12/1925 | Murphy | 70/114 |
| 1,634,933 | 7/1927 | Dalton | 70/113 |
| 2,066,705 | 1/1937 | Vazquez | 70/74 |
| 3,464,728 | 9/1969 | Ruckel et al. | 292/92 |
| 4,534,192 | 8/1985 | Harshbarger et al. | 70/118 |
| 5,375,894 | 12/1994 | Schlack | 292/36 |
| 5,794,467 | 8/1998 | Justice | 70/118 |

FOREIGN PATENT DOCUMENTS

| | | |
|---|---|---|
| 655350 | 4/1986 | Switzerland . |
| 26513 | 11/1907 | United Kingdom . |

*Primary Examiner*—Darnell M. Boucher
*Assistant Examiner*—John B. Walsh
*Attorney, Agent, or Firm*—Michael I. Kroll

[57] ABSTRACT

A door lock system (20) comprising a door frame (22) mounted in an entry (24) of a building (26). An entrance door (28) is hinged at (30) along one side edge to the door frame (22). The entrance door (28) has a standard door lock unit (32) to engage with the door frame (22). A structure (34) is built into the entrance door (28), for engaging with the door frame (22) at a number of other locations thereabout, so that the entrance door (28) will be strengthened against a forced entry. An assemblage (36) is built into the entrance door (28), for retaining the engaging structure (34) to the door frame (22) in a releasing manner. When a person wants to open the entrance door (28) with the stand and a door lock unit (32), the retaining assemblage (36) must first be deactivated to allow the engaging structure (34) to disengage from the door frame (22).

1 Claim, 9 Drawing Sheets

DOOR LOCK SYSTEM

BACKGROUND OF THE INVENTION

1. Field of the Invention

The instant invention relates generally to locking systems and more specifically it relates to a door lock system. The door lock system utilizes a dual rack and pinion assembly operable by inner and outer turn knobs in combination with a key lock, which will lock and unlock a door at a number of locations about the door frame, so that it will strengthen the door against forced entry. The door lock system can be built into all kinds of single and double door entry units in buildings. The number of lock locations about the frame can vary depending upon the type of single or double doors used in the entry unit of the building.

2. Description of the Prior Art

Numerous locking devices have been provided in prior art. For example, U.S. Pat. Nos. 639,325 to Eyster; 1,366,015 to Morris; 1,567,811 to Murphy and 1,634,933 to Dalton all are illustrative of such prior art. While these units may be suitable for the particular purpose to which they address, they would not be as suitable for the purposes of the present invention as heretofore described.

EYSTER, CHARLES

SAFE LOCK

U.S. Pat. No. 636,325

In locking mechanism for safe-doors, a set of bolt work, a combination-lock, means for operating the bolt work and combination-lock, and capable of disengagement with bolt and move into engagement with either.

MORRIS, JOHN

SAFETY LOCK MECHANISM

U.S. Pat. No. 1,366,015

The combination on a door, of a lock at one point, a plurality of bars radiating in different directions to lock the door to the frame at a number of other points, a turning plate to which the inner ends of the bars are connected, and a connection between the turning plate and the lock.

MURPHY, THOMAS F.

DOOR LOCK

U.S. Pat. No. 1,567,811

In combination with a door, locking means therefor including a rotatable part and a manually operable handle therefor at the outer side of the door. A spring projected bolt is mounted upon the door in the plane of the rotatable part. The part has a notch in its periphery to receive one end of the bolt. Key operated means on the door is for retracting the bolt to disengage the same from the notch. Manually releasable means is adapted to coact with the bolt and hold the same when it has been retracted by the key operated means.

DALTON, HARRY M.

LOCKING MECHANISM FOR SAFES

U.S. Pat. No. 1,634,933

In locking mechanism for a safe, the combination with a door and a wall of a door-opening, of a pluripart rotatable locking-bar having an axis of rotatable locking-bar having an axis of rotation extending lengthwise of a joint between the door and the wall. The locking-bar extends substantially throughout the length of the joint. The parts of the bar have a parting plane between them extending lengthwise of the joint. Means for rotating the bar for locating the plane coincident with the joint for unlocked relation of the door or crosswise of the joint for locked relation of the door. Means for maintaining the locking-bar in the last-named relation.

SUMMARY OF THE INVENTION

A primary object of the present invention is to provide a door lock system that will overcome the shortcomings of the prior art devices.

Another object is to provide a door lock system in which a dual rack and pinion assembly operable by inner and outer turn knobs in combination with a key lock will lock and unlock a door at a number of locations about the frame of the door, that will greatly strengthen the door against forced entry.

An additional object is to provide a door lock system that can be built into all kinds Of single and double door entry units in buildings, whereby the number of lock locations about the frame can vary depending upon the type of single or double doors used in the entry unit of the building.

A further object is to provide a door lock system that is simple and easy to use.

A still further object is to provide a door lock system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIGS. 9, 10 and 12 through 18 are diagrammatic perspective views of various double door entry units, with parts installed in place.

Similar reference characters denote corresponding features consistently throughout the attached drawings.

DESCRIPTION OF THE PREFERRED EMBODIMENTS

Figure 1:
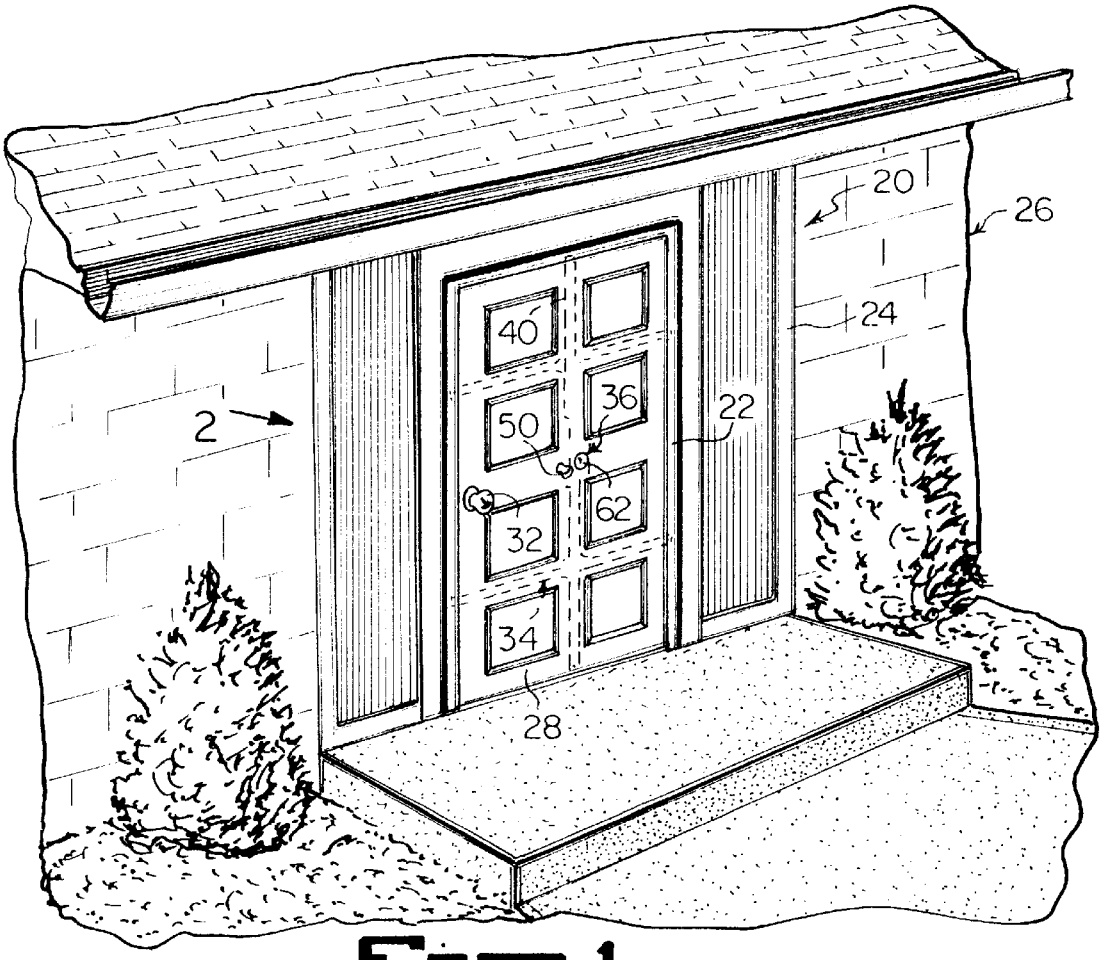
FIG. 1 is a front perspective view of a single door entry unit in a building with the present invention shown in dotted lines installed within a single door.

Turning now descriptively to the drawings, in which similar reference characters denote similar elements throughout the several views, the figures illustrate present invention being a door lock system. With regard to the reference numerals used, the following numbering is used throughout the various drawing figures.

20 door lock system
22 door frame of 20
24 entry of 26
26 building
28 entrance door of 20
30 hinge of 28
32 standard door lock of 28
34 engaging structure of 20
36 retaining assemblage of 20
38 slot in 22
40 guide track of 34
42 roller in 40
44 locking assembly of 34
46 double rack and pinion mechanism of 34
48 inner turn knob
50 outer turn knob
52 first vertical bar of 44
54 second vertical bar of 44
56 horizontal bar of 44
58 link of 56
60 side slot in 52 of 36
62 lock of 36
64 bolt of 36
66 key for 62
68 door lock system
70 door frame of 68
72 first entrance door of 68
74 second entrance door of 68
76 hinge of 72, 74
78 standard door lock of 72, 74
80 engaging structure of 68
82 retaining assemblage of 88
84 slot in 70
86 guide track
88 locking assembly
90 double rack and pinion mechanism of 80
92 first vertical bar of 88
94 second vertical bar of 88
96 horizontal bar of 88
98 link of 96
100 side slot in 92 of 82
102 lock of 82
104 bolt of 82

Figure 2:
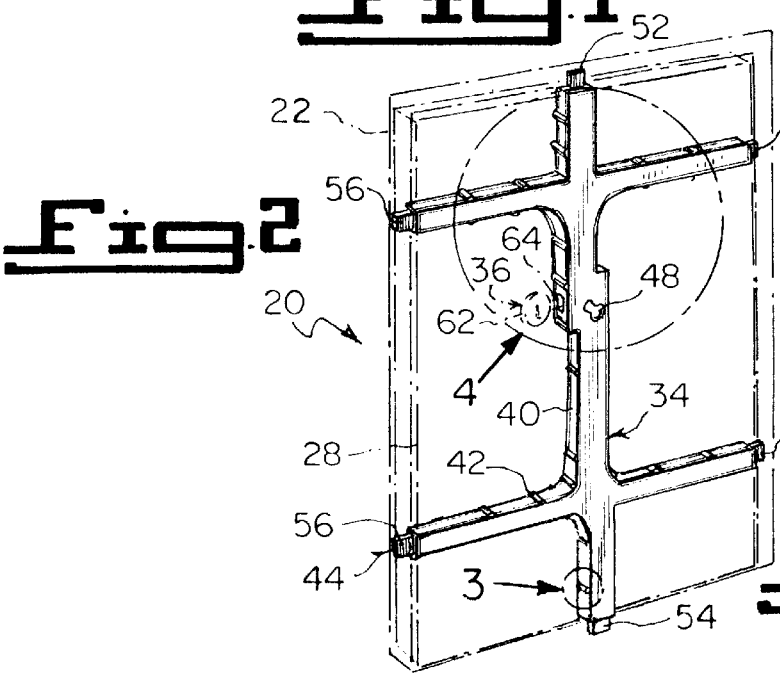
FIG. 2 is a rear perspective view taken in the direction of arrow 2 in FIG. 1, of the present invention with the single door shown in phantom.
Figure 3:
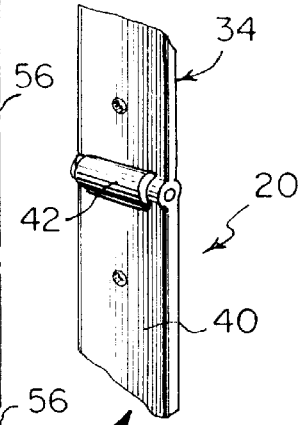
FIG. 3 is an enlarged perspective view of an area in FIG. 2 as indicated by arrow 3.
Figure 4:
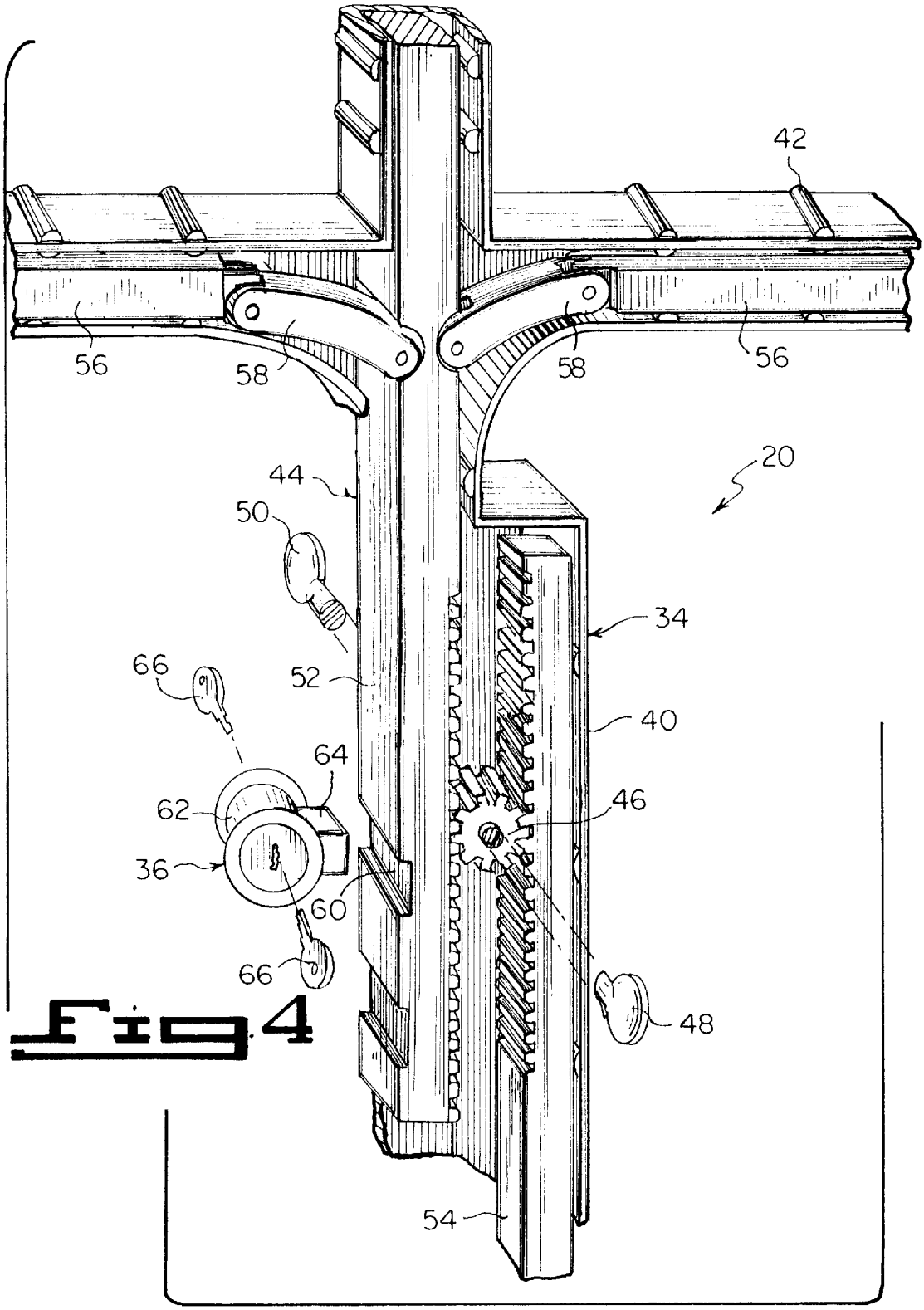
FIG. 4 is an enlarged partial exploded perspective view of an area in FIG. 2 as indicated by arrow 4 with the top cover of the guide track removed therefrom.
Figures 5, 6, 7:
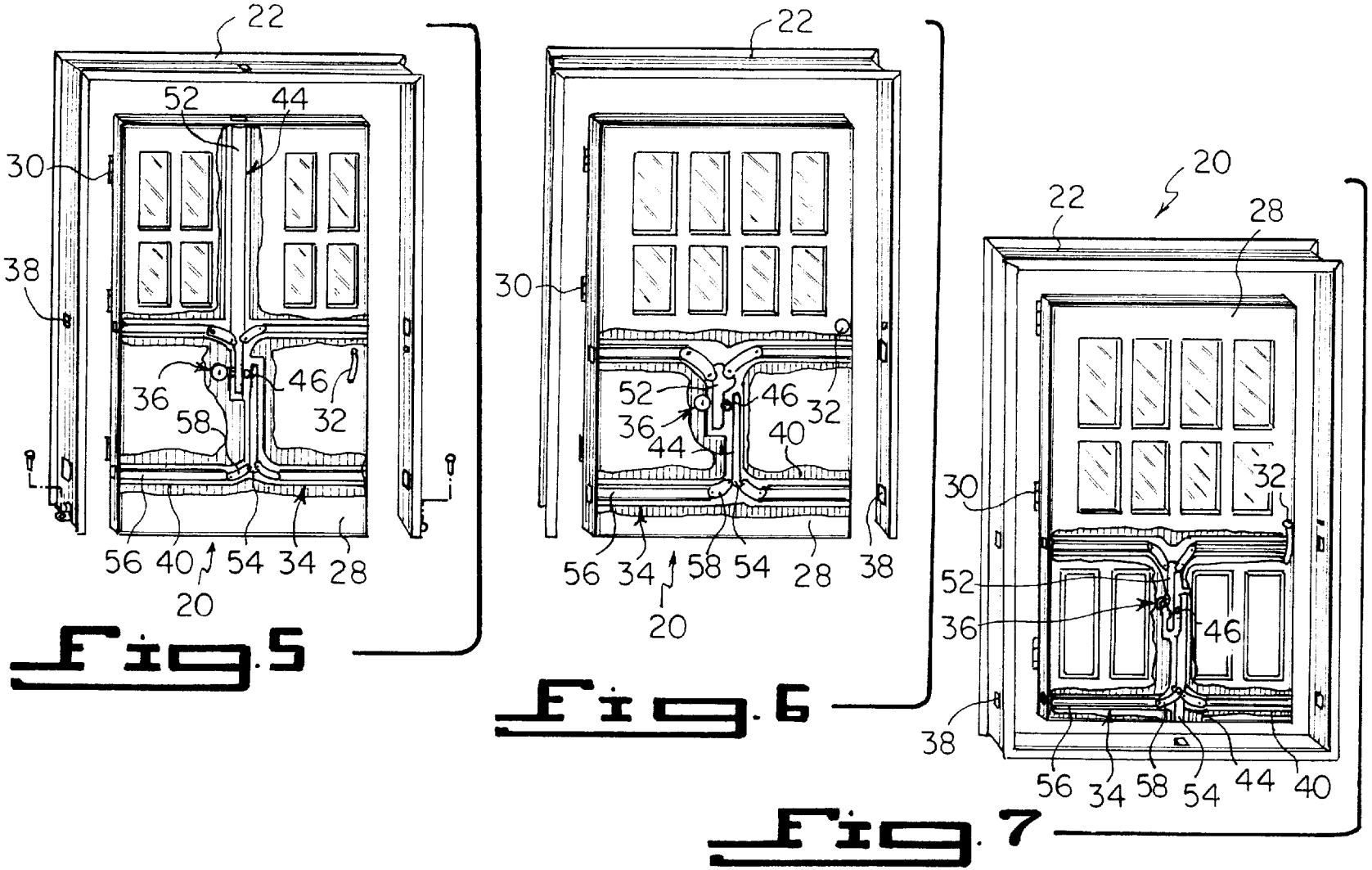
FIGS. 5 through 8 are diagrammatic perspective view of other single door entry units, with parts of the doors broken away to see the present invention installed in place.
Figure 8:
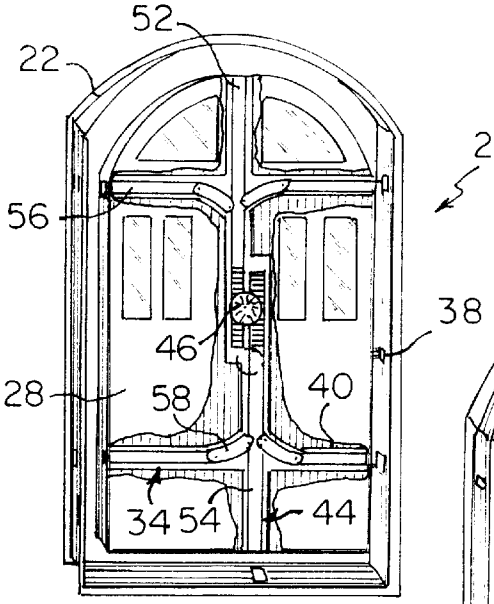

The door lock system 20 as shown in FIGS. 1 through 8, comprises a door frame 22 mounted in an entry 24 of a building 26. An entrance door 28 is hinged at 30 along one side edge to the door frame 22. The entrance door 28 has a standard door lock unit 32 to engage with the door frame 22. A structure 34 is built into the entrance door 28, for engaging with the door frame 22 at a number of other locations thereabout, so that the entrance door 28 will be strengthened against a forced entry. An assemblage 36 is built into the entrance door 28, for retaining the engaging structure 34 to the door frame 22 in a releasing manner. When a person wants to open the entrance door 28 with the stand and a door lock unit 32, the retaining assemblage 36 must first be deactivated to allow the engaging structure 34 to disengage form the door frame 22.

The door frame 22 has a plurality of spaced apart slots 38 thereabout. The engaging structure 34 includes a guide track 40 having a plurality of spaced apart rollers 42. The guide track 40 is mounted within the entrance door 28. A locking assembly 44 is carried within the guide track 40 in a sliding manner upon the rollers 42. A double rack and pinion mechanism 46 has inner and outer turn knobs 48, 50 in the guide track 48 to move the locking assembly, so that some of the distal free ends of the locking assembly 44 can enter and exit the slots 38 in the door frame 22.

The locking assembly 44 contains two spaced apart vertical bars 52, 54 to house the double rack and pinion mechanism 46 therebetween. Four horizontal bars 56 are provided. Two of the horizontal bars 56 are linked at 58 to the first vertical bar 52. The other two horizontal bars 56 are linked at 58 to the second vertical bar 54. When the double rack and pinion mechanism 46 is operated by one of the inner and outer turn knobs 48, 50 in clockwise and counterclockwise directions, the vertical bars 52, 54 will slide up and down, while the horizontal bars 56 will slide back and fourth within the guide track 40.

The retaining assemblage 36 consists of one of the vertical bars 52 of the locking assembly 44 having a side slot 60 therein. A key operated lock 62 is mounted within the entrance door 28 adjacent to the side slot 62 in the vertical bar 52. A bolt 64 is operable by the lock 62 to enter and exit the side slot 60, when the lock 62 is turned by a key 66 inserted with the lock 62.

Figure 10:
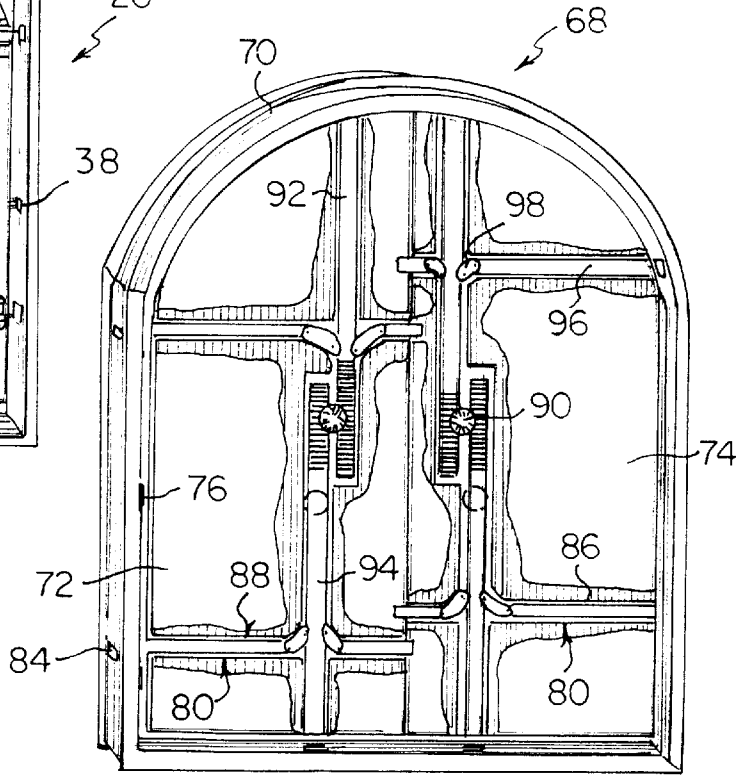
Figure 9:
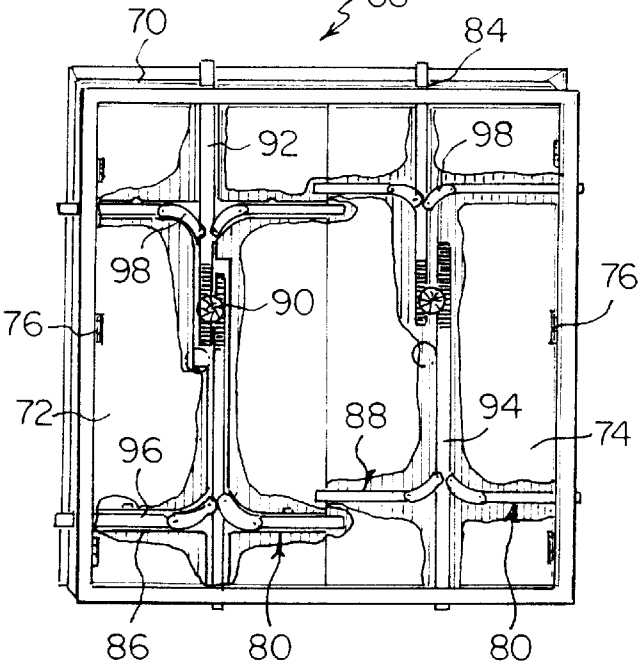
Figure 11:
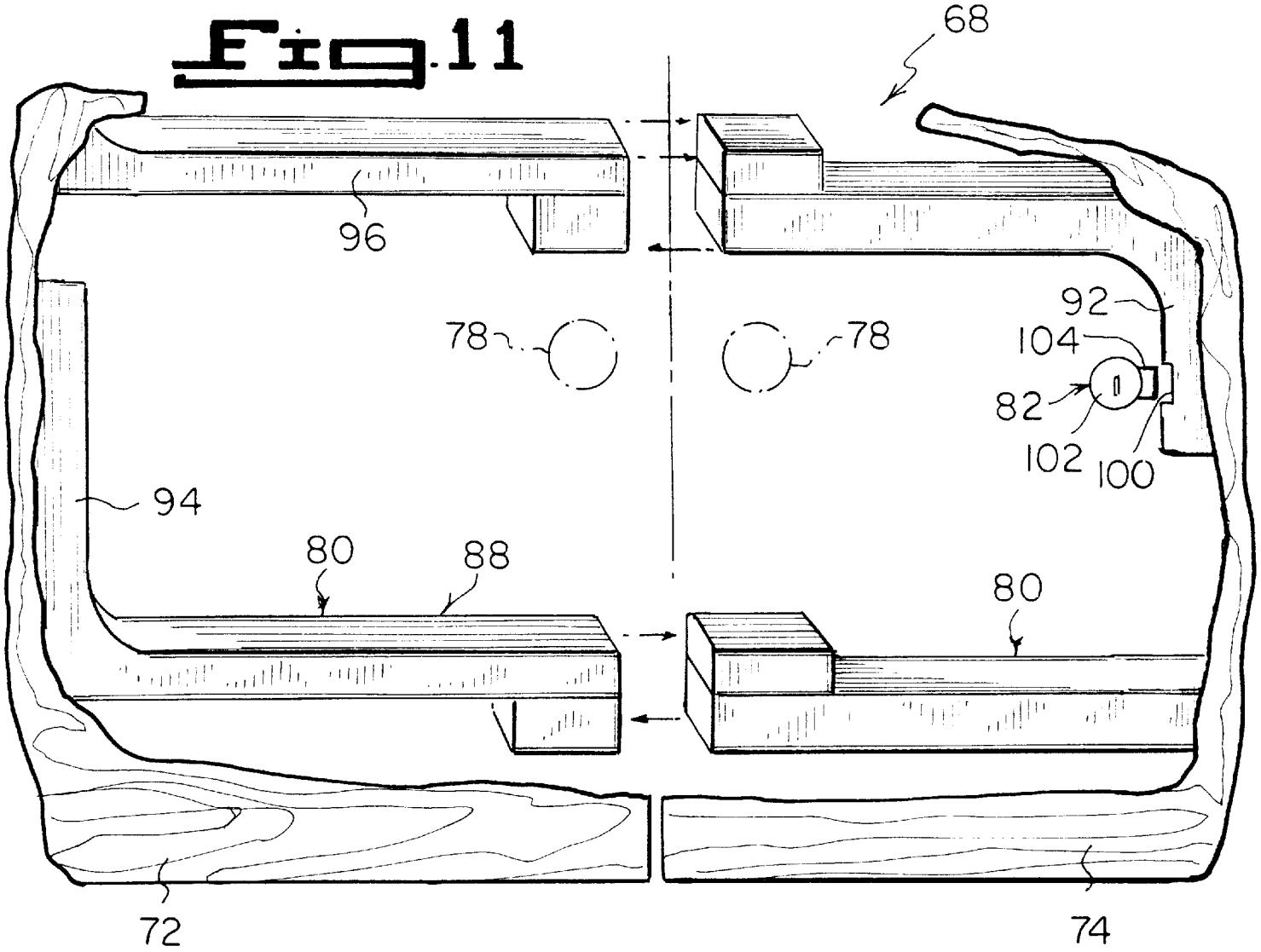
FIG. 11 is an enlarged perspective view of an area in FIG. 12 as indicated by arrow 11, with portions of the double doors broken away.
Figure 12:
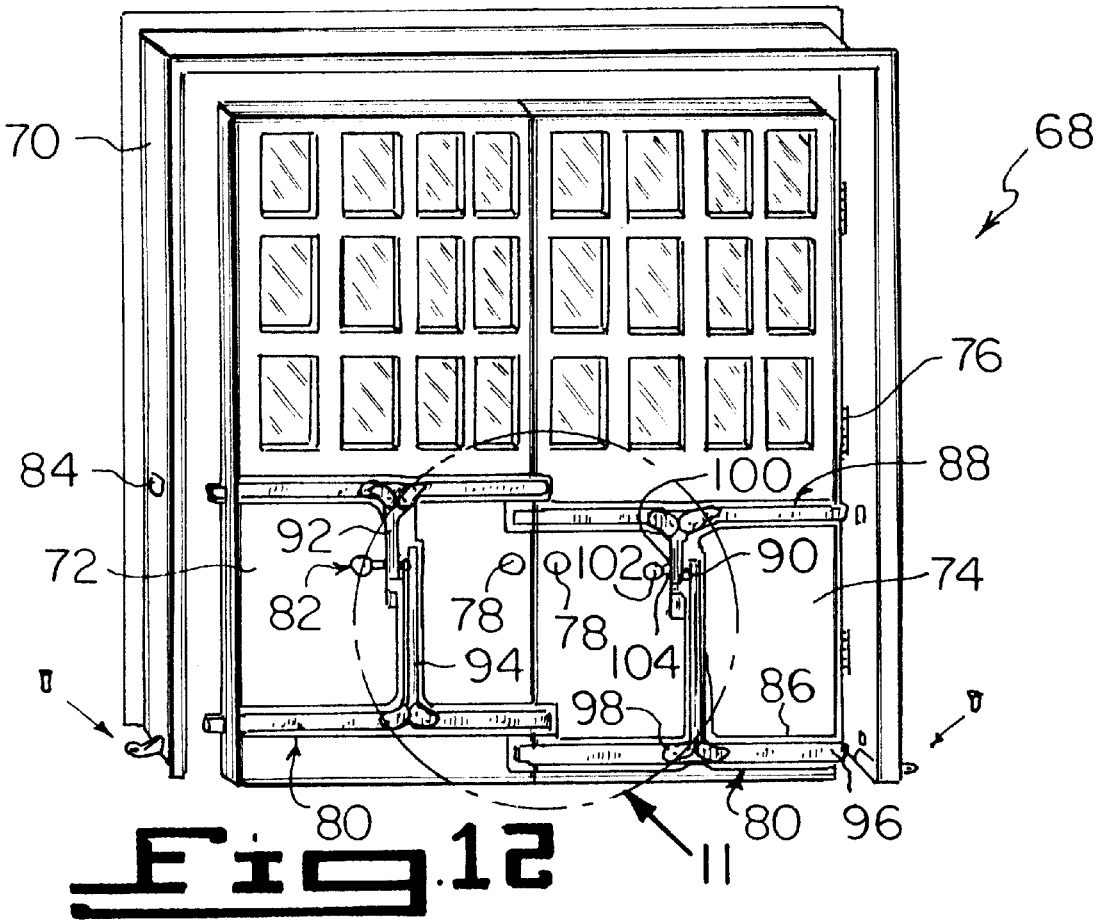
Figure 13:
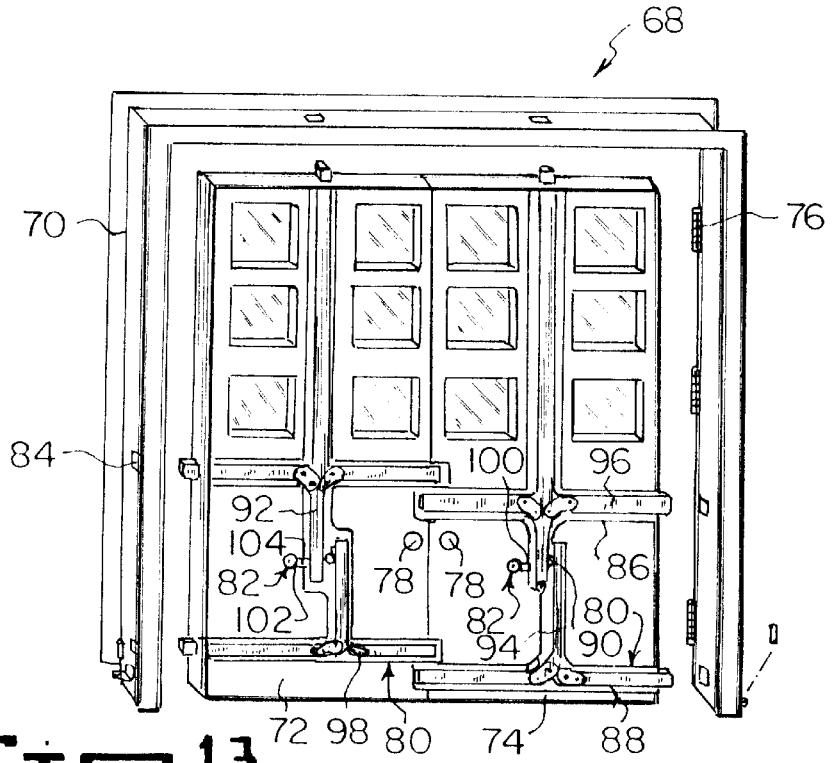
Figure 14:
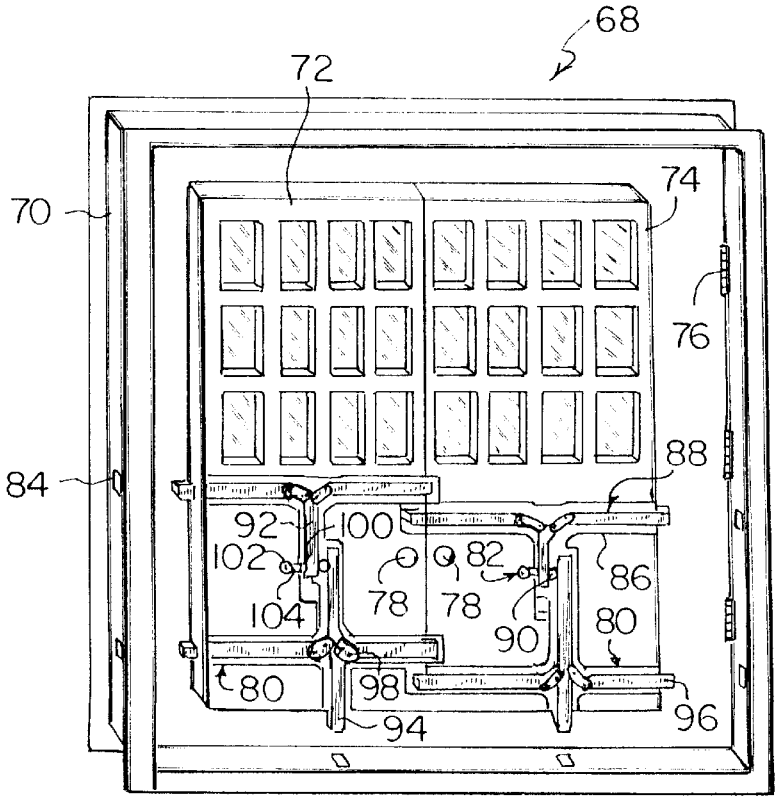
Figure 15:
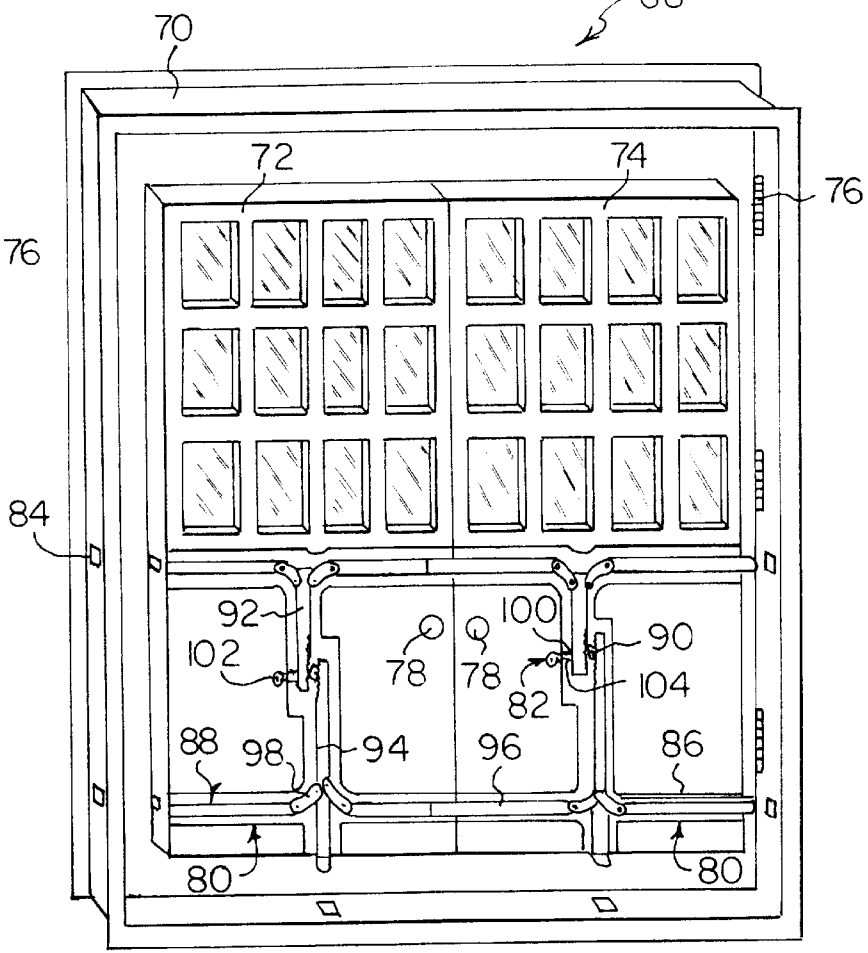
Figure 15:
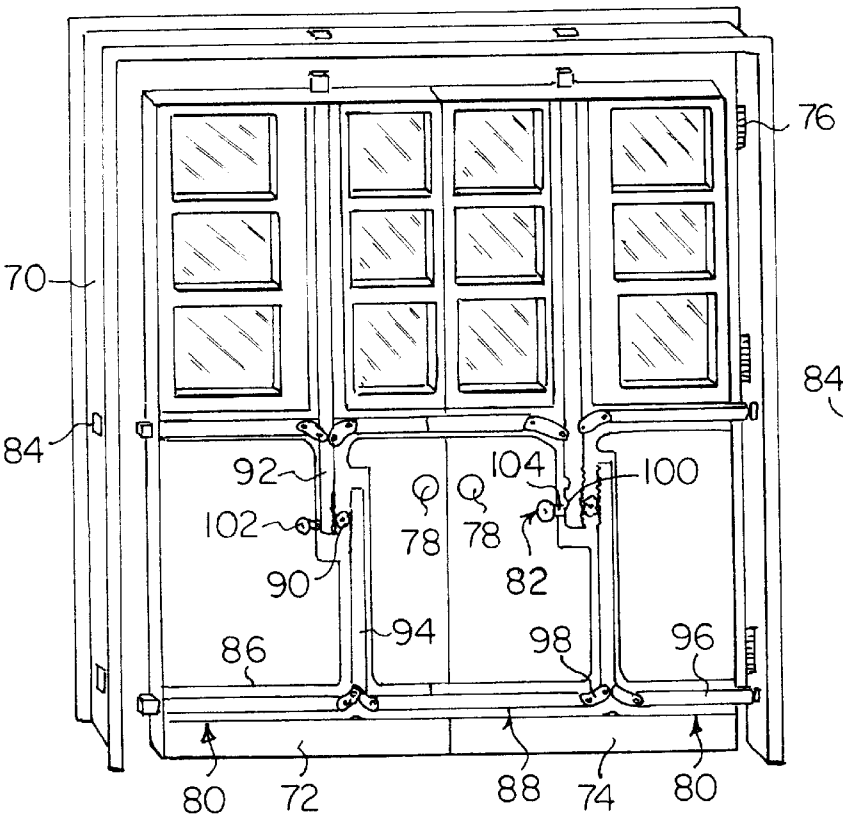
Figure 18:
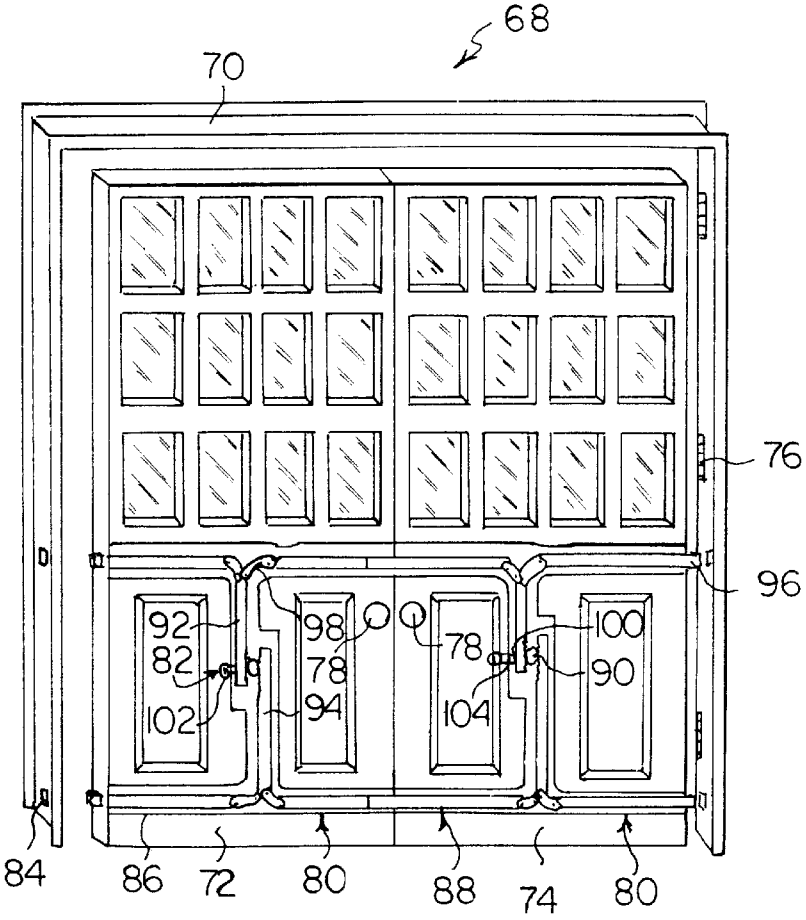
Figure 17:
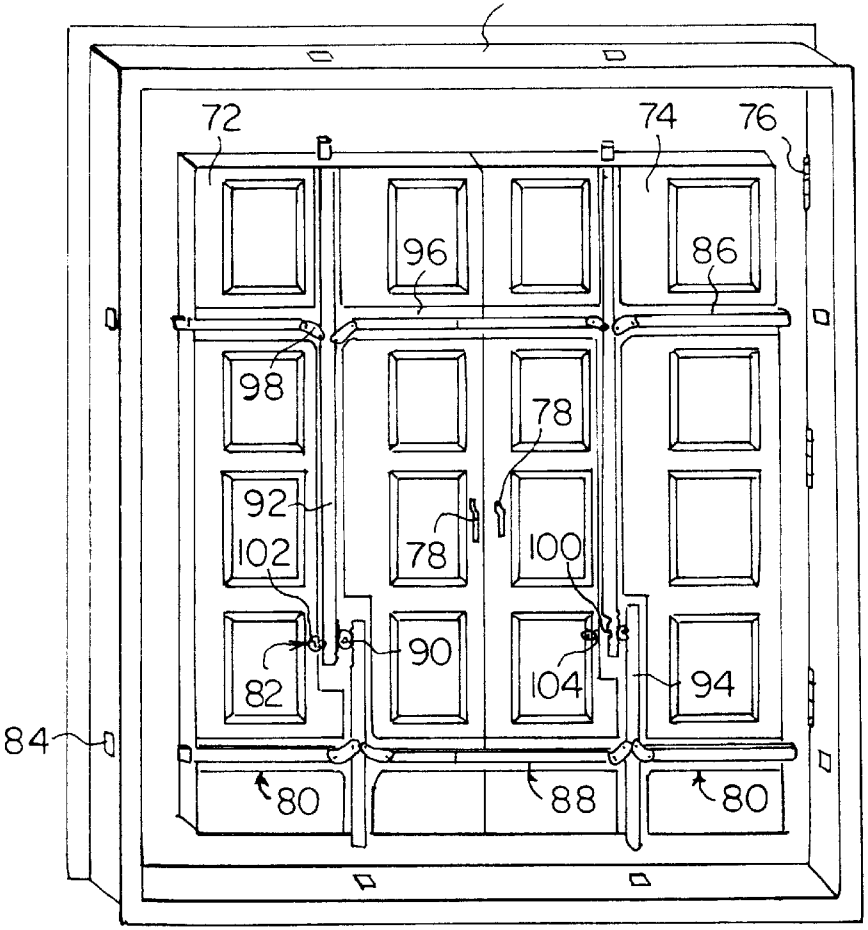

The door lock system 68 shown in FIGS. 9 through 18, comprises a door frame 70 mounted in an entry of a building (not shown). A pair of entrance doors 72, 74 are hinged at 76 along opposite side edges to the door frame 70. Each of the entrance doors 72, 74 have a standard door lock unit 78 to engage with the door frame 70. A structure 80 is built into each of the entrance doors 72, 74, for engaging with the door frame 70 at a number of other locations thereabout, so that each of the entrance doors 72, 74 will be strengthened against a forced entry. An assemblage 82 is built into each of the entrance doors 72, 74, for retaining the engaging structure 80 to the door frame 70 in a releasing manner. When a person wants to open each of the entrance doors 72, 74 with the standard door lock unit 78, the retaining assemblage 82 must first be deactivated, to allow the engaging structure 80 to disengage from the door frame 70.

The door frame 70 has a plurality of spaced apart slots 84 thereabout. Each engaging structure 80 includes a guide track 86 having a plurality of spaced apart rollers (not shown). The guide track 86 is mounted within the entrance door 72, 74. A locking assembly 88 is carried within the guide track 86 in a sliding manner upon the rollers. A double rack and pinion mechanism 90 has inner and outer turn knobs (not shown) in the guide track 86 to move the locking assembly 88, so that some of the distal free ends of the locking assembly 88 can enter and exit the slots 84 in the door frame 70.

The locking assembly 88 contains two spaced apart vertical bars 92, 94 to house the double rack and pinion mechanism 90 therebetween. Four horizontal bars 96 are provided. Two of the horizontal bars 96 are linked at 98 to the first vertical bar 92. The other two horizontal bars 96 are linked at 98 to the second vertical bar 94. When the double rack and pinion mechanism 90 is operated by one of the inner and outer turn knobs in clockwise and counterclockwise directions, the vertical bars 92, 94 will slide up and down, while the horizontal bars 96 will slide back and fourth within the guide track 86.

Each retaining assemblage 82 consists of one of the vertical bars 92 of the locking assembly having a side slot 100 therein. A key operated lock 102 is mounted within the entrance door 72, 74 adjacent to the side slot 100 in the vertical bar 92. A bolt 104 is operable by the lock 102 to enter and exit the side slot 100, when the lock 102 is turned by a key (not shown) inserted within the lock 102.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A door lock system comprising:

a) a door frame mounted in an entry of a building;

b) an entrance door hinged along one side edge to said door frame, said entrance door having a standard door lock unit to engage with said door frame;

c) means built into said entrance door for engaging with said door frame at a number of locations at the top, bottom and sides, so that said entrance door will be strengthened against a forced entry;

d) means built into said entrance door for retaining said engaging means to said door frame in a releasing manner, so that when a person wants to open said entrance door with the standard door lock unit, said retaining means must first be deactivated to allow said engaging means to disengage from said door frame;

e) said engaging means comprising a guide track with oppositely facing spaced walls having a plurality of spaced apart rollers connecting the walls along the edges thereof forming an enclosed track, a locking assembly mounted within said guide track for sliding movement in contact with said rollers to make the engagement with said door frame, and a double rack and pinion mechanism having inner and outer turn knobs extending from said pinion to move said locking assembly in and out of engagement with said door frame;

f) said locking assembly including first and second spaced apart vertical bars for engaging the top and bottom of said door frame respectively and having teeth facing each other with said pinion in between engaging both said teeth forming said double rack and pinion mechanism, two horizontal bars linked to said first vertical bar and two horizontal bars linked to said second vertical bar, so that when said double rack and pinion mechanism is operated by one of said inner and outer turn knobs in clockwise and counterclockwise directions, said vertical bars will slide up and down while said horizontal bars will slide back and fourth within said guide track to engage or disengage from the sides of said door frame;

g) means for locking said locking assembly in which one of said vertical bars is provided with a pair of spaced side slots and a key operated lock mounted within said door adjacent to said side slots in said vertical bar, and a bolt operable by said lock to enter and exit either of said side slots depending on the position of said vertical bar, said key operated lock being adjacent the outer turn knob in the middle of said door.

* * * * *